US007699654B2

(12) United States Patent
Tanaka et al.

(10) Patent No.: US 7,699,654 B2
(45) Date of Patent: Apr. 20, 2010

(54) ELECTRIC WIRE AND WATER-STOPPING METHOD THEREFOR

(75) Inventors: Tetsuji Tanaka, Mie (JP); Hiroki Hirai, Mie (JP); Yoshito Sakai, Mie (JP); Toshiaki Suzuki, Mie (JP)

(73) Assignees: Autonetworks Technologies, Ltd., Mie (JP); Sumitomo Wiring Systems, Ltd., Mie (JP); Sumitomo Electric Industries, Ltd., Osaka-shi (JP)

( * ) Notice: Subject to any disclaimer, the term of this patent is extended or adjusted under 35 U.S.C. 154(b) by 4 days.

(21) Appl. No.: 12/219,593

(22) Filed: Jul. 24, 2008

(65) Prior Publication Data

US 2008/0293283 A1 Nov. 27, 2008

Related U.S. Application Data

(62) Division of application No. 11/214,916, filed on Aug. 31, 2005, now Pat. No. 7,506,439, which is a division of application No. 10/848,116, filed on May 19, 2004, now Pat. No. 7,238,884.

(30) Foreign Application Priority Data

May 27, 2003 (JP) ..... P2003-149675

(51) Int. Cl.
*H01R 13/58* (2006.01)

(52) U.S. Cl. ..... 439/604; 439/519; 439/736; 439/883

(58) Field of Classification Search ..... 439/519, 439/521, 522, 523, 604, 606, 736, 883
See application file for complete search history.

(56) References Cited

U.S. PATENT DOCUMENTS

| | | | | |
|---|---|---|---|---|
| 2,815,497 | A | 12/1957 | Redslob | |
| 4,696,649 | A * | 9/1987 | Smorzaniuk et al. | 439/98 |
| 5,004,868 | A | 4/1991 | Singor | |
| 5,220,198 | A * | 6/1993 | Tsuji | 257/731 |
| 5,532,433 | A | 7/1996 | Endo et al. | |
| 5,809,635 | A | 9/1998 | Aoyagi et al. | |
| 6,517,381 | B2 | 2/2003 | Kondo | |
| 6,951,491 | B2 * | 10/2005 | Sakaguchi et al. | 439/879 |
| 7,238,884 | B2 * | 7/2007 | Tanaka et al. | 174/74 R |
| 7,506,439 | B2 * | 3/2009 | Tanaka et al. | 29/857 |
| 2001/0003687 | A1 * | 6/2001 | Kondo | 439/604 |
| 2001/0003688 | A1 * | 6/2001 | Kondo | 439/604 |
| 2008/0283268 | A1 * | 11/2008 | Iwasaki et al. | 174/78 |
| 2008/0293283 | A1 * | 11/2008 | Tanaka et al. | 439/321 |

FOREIGN PATENT DOCUMENTS

| | | |
|---|---|---|
| DE | 695 23 728 T2 | 12/2001 |
| DE | 101 38 689 A1 | 3/2002 |
| DE | 102 02 102 A1 | 11/2002 |
| DE | 103 16 603 B3 | 11/2004 |

(Continued)

*Primary Examiner*—James Harvey
(74) *Attorney, Agent, or Firm*—Oliff & Berridge, PLC

(57) ABSTRACT

An electric wire including a conductor; and a coating material outside of the conductor, wherein a water-stopping agent having a flowability is located between the conductor and the coating material on a connection terminal side of the electric wire.

7 Claims, 2 Drawing Sheets

FOREIGN PATENT DOCUMENTS

| | | | |
|---|---|---|---|
| EP | 0 720 179 | A2 | 7/1996 |
| EP | 0 815 628 | B1 | 1/2002 |
| GB | 2 270 792 | A | 3/1994 |
| JP | A06-084416 | | 3/1994 |
| JP | A-7-106041 | | 4/1995 |
| JP | A07-183063 | | 7/1995 |
| JP | A-11-232935 | | 8/1999 |
| JP | A 2001-167640 | | 6/2001 |
| JP | A 2001-167821 | | 6/2001 |

* cited by examiner

ELECTRIC WIRE AND WATER-STOPPING METHOD THEREFOR

This is a Division of application Ser. No. 11/214,916 filed Aug. 31, 2005, which in turn is a Division of application Ser. No. 10/848,116 filed May 19, 2004. The entire disclosure of the prior application is hereby incorporated by reference herein in its entirety.

BACKGROUND

The present invention relates to a technique for water-stopping an earthing electric wire to connect an electric circuit to be mounted on a vehicle or the like with the earth.

Generally, the earthing electric wire is so connected with a suitable earthing portion (e.g., the body of a vehicle) that an earthing connection terminal fixed on its terminal is exposed to the outside. Therefore, water may invade from that exposed terminal and may obstruct the normal action of a circuit if it invades into the circuit through the inner side of a coating material.

As a method for water-stopping such earthing electric wire, therefore, a highly viscous seal resin is molded to cover the electric wire terminal, on which the earthing connection terminal is fixed, as disclosed in JP-A-2001-167821 (page 4, FIG. 4).

In the method of molding the resin around the electric wire terminal, as described above, this molding takes troubles and large-scaled facilities, and the electric wire terminal is bulky. Therefore, the method has defects that the wiring works are troublesome and that the electric wire terminal cannot be laid over another earthing connection terminal, for example.

SUMMARY

It is an object of the invention to perform the treatment of water-stopping the earthing electric wire reliably by the simple operation without increasing the volume of an electric wire terminal portion so much.

In order to achieve the above-specified object, according to the invention, there is provided a method for water-stopping an electric wire having a coating material on the outer side of a conductor, such as an earthing electric wire for connecting a circuit mounted on a vehicle with the earth, comprising: a water-stopping agent feeding step of feeding a water-stopping agent having a flowability to one terminal of the earthing electric wire; and a pressure reducing step of reducing the pressure by sucking the air in the inner side of the coating material of the earthing electric wire, during or after the feed of the water-stopping agent, from the other terminal of the earthing electric wire so that the water-stopping agent may penetrate into the inner side of the coating material.

According to this construction, in addition to the water-stopping agent feeding step of feeding the water-stopping agent to one terminal of the earthing electric wire, the pressure reducing step of reducing the pressure on the inner side of the insulating material by sucking the air from the other terminal of the earthing electric wire is performed so that the water-stopping agent fed can penetrate sufficiently into the inner side of the coating material. As a result, the reliable water-stopping treatment can be realized without changing the volume of the electric wire terminal portion substantially. In the earthing electric wire subjected to the water-stopping treatment by that method, the water passage on the inner side of the insulating material can be reliably blocked to prevent the water from invading into the vehicle-mounted circuit from the earth connection portion along the earthing electric wire.

The water-stopping agent feeding step may be performed before the terminal is fixed on the electric wire terminal. In this case, the water-stopping structure may be affected by the addition of an external force accompanying the work of fixing that terminal. A more reliable water-stopping treatment can be realized, if a terminal fixing step of fixing a connection terminal on one terminal of the earthing electric wire is performed before the water-stopping agent feeding step, and, at the water-stopping agent feeding step, the water-stopping agent is fed to the terminal, on which the connection terminal is fixed.

Here, at the terminal fixing step, it is preferred that an earthing connection terminal to be connected with the body earth of the vehicle is fixed on one terminal of the earthing electric wire. As a result, the invasion of the water into the earthing electric wire can be blocked on the entrance side (i.e. on the side of the earthing connection terminal).

The water-stopping agent to be used in the invention may also be one having properties hardly changed with time. If, after the water-stopping agent feeding step, the water-stopping agent fed is set on the inner side of the coating material, however, a stabler water-stopping structure can be obtained by lowering the flowability of the water-stopping agent by the later setting while retaining the satisfactory flowability at the time of feeding the water-stopping agent.

The pressure reducing step may be performed individually for each of the earthing electric wires. If the terminals of a plurality of earthing electric wires are connected to a common pump so that the earthing electric wires are simultaneously subjected to the pressure reducing step, however, a water-stopping treatment of a higher efficiency can be realized.

DETAILED DESCRIPTION OF EMBODIMENTS

A preferred embodiment of the invention will be described with reference to the accompanying drawings.

A method for water-stopping an earthing electric wire according to this embodiment includes the following steps.

1) Terminal Contract-Bonding Step

Figure 1A:
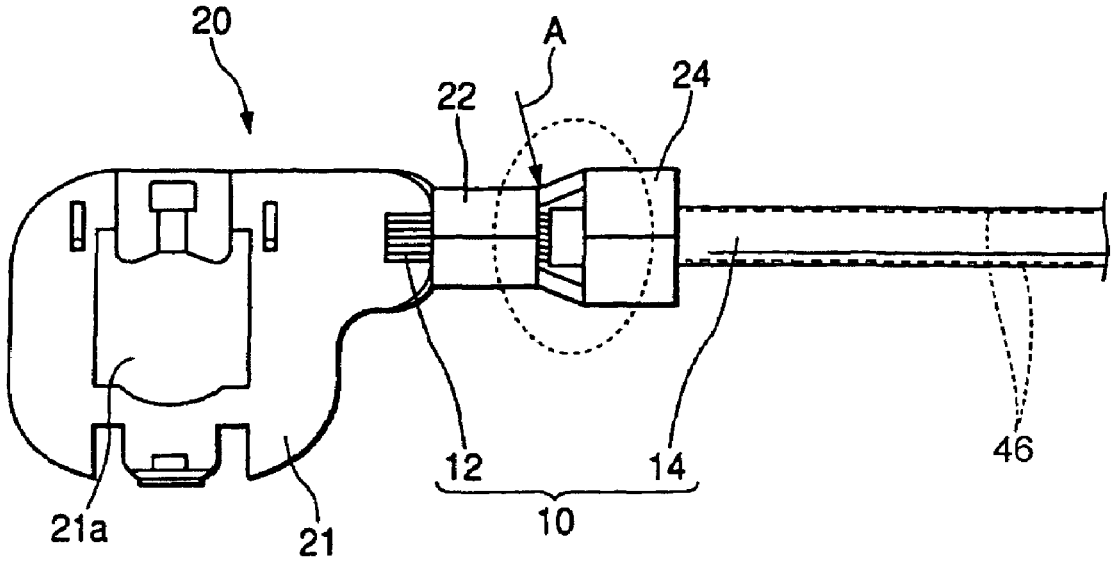
FIG. 1A is a top plan view showing a structure according to the embodiment of the invention, in which an earthing connection terminal is contact-bonded and fixed on one terminal of an earthing electric wire.
Figure 1B:
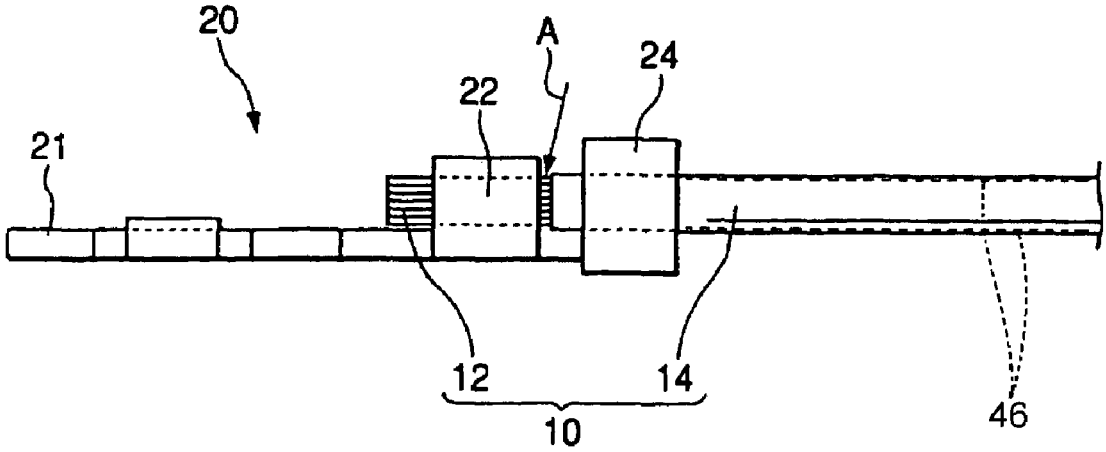
FIG. 1B is a front elevation of the same as FIG. 1A.

At this step, an earthing connection terminal 20 is contact-bonded to one terminal of an earthing electric wire 10, as shown in FIGS. 1A and 1B.

This earthing electric wire 10 is exemplified by an insulating electric wire having a coating material 14 around a conductor 12. The coating material 14 is removed at its one terminal to a predetermined length to expose the conductor 12.

Hereinafter, "water" defines water including cleaning liquid, cooling fluid, and any other fluid to obstruct a normal operation of a circuit mounted on a vehicle if it invades into the circuit through an inner side of a coating material of the earthing electric wire.

To the terminal of this earthing electric wire 10, there is contact-bonded the earthing connection terminal 20, as shown in FIGS. 1A and 1B. The shown earthing connection terminal 20 is made of a single metal sheet, and has an integral construction including an earth connection portion 21 to be connected with the body earth of a vehicle, a conductor barrel 22 and an insulation barrel 24. In the earth connection portion 21, there is formed a bolt inserting hole 21*a*, into which the not-shown bolt can be inserted. The earth connection portion 21 is fastened with that bolt to the body of the vehicle so that it is electrically connected with the body (i.e., connected with the body earth).

With the two barrels 22 and 24 of the earthing connection terminal 20 being opened, the terminal of the earthing electric wire 10, which has been cleared of the coating material 14, as described above. After this, the conductor barrel 22 and the insulation barrel 24 are individually closed and contact-bonded (or caulked) on the conductor 12 and the coating material 14.

2) Pressure Reducing Step

At this step, the air on the inner side of the coating material 14 of the earthing electric wire 10 is sucked to reduce the pressure from the other terminal (i.e., the terminal on the other side of the terminal having fixed the earthing connection terminal 20) of the earthing electric wire 10.

Figure 2:
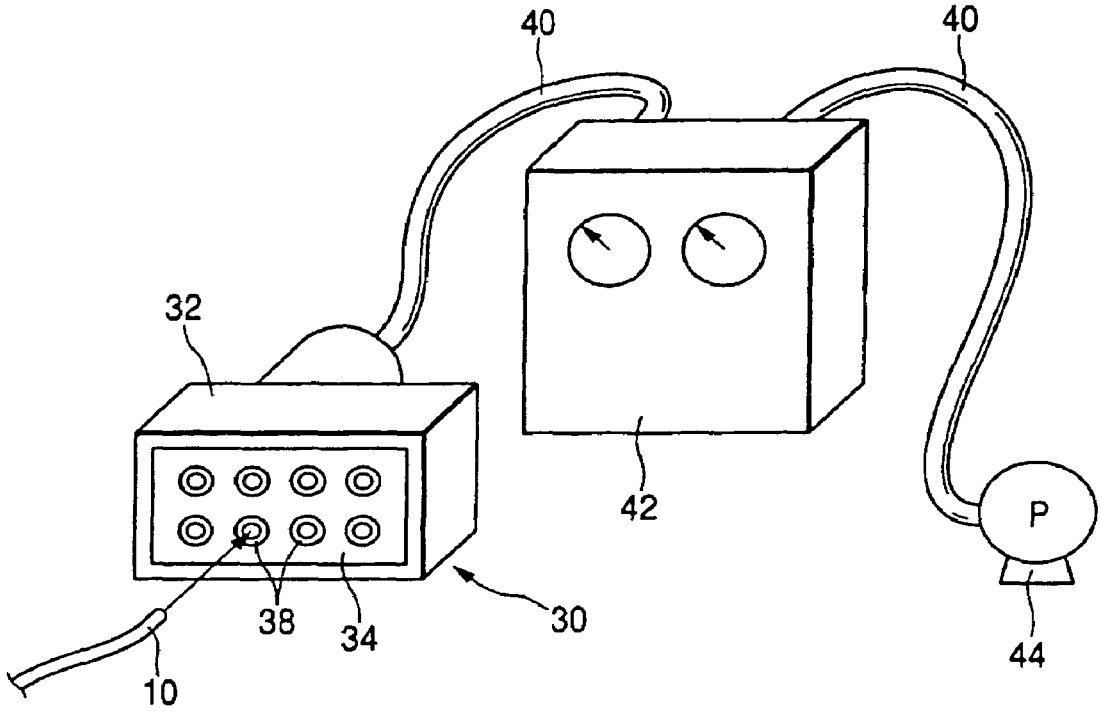
FIG. 2 is a diagram showing an example of a device for reducing the pressure on the inner side of an insulating material in the earthing electric wire.

This pressure reducing step may be performed each for one earthing electric wire 10. In this embodiment, however, a plurality of earthing electric wires 10 are simultaneously subjected to the pressure reducing step so as to make the water-stopping treatment efficient. Specifically, as shown in FIG. 2, the pressure reducing steps of the individual earthing electric wires 10 are simultaneously performed with a suction pump 44 by connecting the terminals of the earthing electric wires 10 with a common electric wire connecting device 30 and by connecting this electric wire connecting device 30 to the suction port of the suction pump 44 through a pressure control board 42.

The shown electric wire connecting device 30 is provided with an internally sealed housing 32, the sealed space of which is connected to the suction port of the suction pump 44 via a suitable piping 40 and the aforementioned control board 42.

Figure 3:
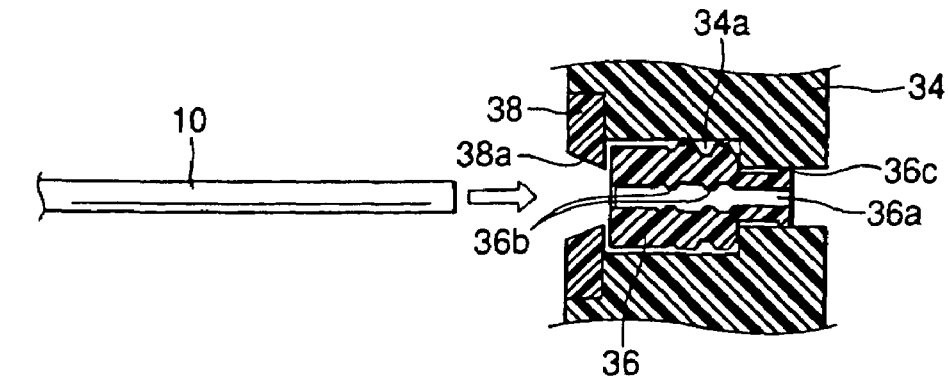
FIG. 3 is a sectional view showing an electric wire connecting portion of the electric wire connecting device shown in FIG. 2.

On the front wall of the housing 32, there is mounted a rubber plug holding plate 34. In this rubber plug holding plate 34, there are held a plurality of rubber plugs 36, which are arranged vertically and horizontally, as shown in FIG. 3. The terminals of the individual earthing electric wires 10 are connected to the individual rubber plugs 36.

Specifically in the rubber plug holding plate 34, there are formed a plurality of rubber plug mounting holes 34*a*, which extend through the holding plate 34 in the thickness direction. The rubber plugs 36 are individually fitted in the individual rubber plug mounting holes 34*a*.

Each rubber plug 36 is formed into a cylindrical shape having a through hole 36*a* on its center axis. On the inner circumference of the through hole 36*a*, there are formed sealing ridges 36*b*. These sealing ridges 36*b* are forced to contact with the surface of the insulating material 14 of the earthing electric wire 10 inserted into the through hole 36*a*, thereby to play a role to hold the sealed state in the housing 32. On the outer circumference of the rubber plug 36, there is likewise formed a sealing ridge 36*c*, which is forced to contact with the inner circumference of the rubber plug mounting hole 34*a* thereby to hold the sealing state.

On the outer side end portion of each rubber plug mounting hole 34*a*, there is mounted a rubber plug cover 38, which covers the outer circumferential portion of the rubber plug 36 from the outer side. This rubber plug cover 38 has a tapered through hole 38*a* at its center for inducing the terminal of the earthing electric wire 10 into the through hole 36*a* of the rubber plug 36.

In this electric wire connecting device 30, the earthing electric wires 10 can be connected to the common sealed space in the housing by press-fitting the terminals (i.e., the terminals on the opposite side of the terminals, on which the earthing connection terminal 20 is fixed) of the individual earthing electric wires 10 in the deeper through holes 36*a* of the rubber plugs 36 through the through holes 38*a* of the individual rubber plug covers 38. Under the control of the pressure control board 42, moreover, the pressure in that sealed space is reduced to a constant vacuum by the action of the suction pump 44 so that the inner spaces of the insulating materials of the individual earthing electric wires 10 can be individually evacuated at the same time.

3) Water-Stopping Agent Feeding Step

While the pressure reducing step being executed, a water-stopping agent having a flowability is fed to one terminal (i.e., the terminal, on which the earthing connection terminal 20 is fixed) of each earthing electric wire 10. Specifically, the water-stopping agent is dripped by a dispenser to the position, as indicated by arrow A in FIGS. 1A and 1B, that is, to the portion near the terminal end of the insulating material 14. This dripping position can be suitably set according to the terminal structure.

At this time of feeding the water-stopping agent, the inside of the insulating material 14 is evacuated, as described above. Even if the water-stopping agent 14 has a more or less high viscosity, therefore, it penetrates without fail to the inside of the insulating material 14 thereby to construct the water-stopping structure for blocking the water passage in the insulating material 14.

The water-stopping agent used herein may have a flowability at least when it is fed, and may hold a viscosity when the electric wire is used. Therefore, the water-stopping agent may have its properties hardly changed with time but is preferably hardened after fed to enhance the viscosity.

Specifically, it has been confirmed that the water-stopping agent is enabled to penetrate into the insulating material 14, if it has an initial viscosity of about 0.006 to 6 Pa·s, by reducing the pressure under about 10 Kpa to 100 Kpa for 5 to 120 seconds. The water-stopping agent is preferably exemplified by a silicone resin, silicone rubber, grease or an adhesive having a viscosity and an elasticity. The silicone rubber can be used no matter whether it might be a two-liquid type (which starts to set when two liquids are mixed) or a one-liquid type (which naturally sets with only one liquid).

Unlike the conventional method, by which the electric wire terminal is molded therearound with a resin, according to the method thus far described, the earthing electric wire can be reliably subjected to the water-stopping treatment without enlarging the terminal but by the simple operation.

Here in the aforementioned method, the water-stopping agent feeding step is performed while the pressure reducing step being executed. In the invention, however, the water-stopping agent fed can be sucked to penetrate into the insulating material, too, even if the pressure reducing step is started before the water-stopping agent sets after the water-stopping agent feeding step.

On the other hand, the water-stopping agent feeding step can also be performed before the terminal fixing step. In this case, however, the water-stopping structure by the fed water-stopping agent may be deformed or cracked by an external force coming from the contact bonding or the like. If the water-stopping agent feeding step is performed after the terminal fixing step, as described before, it is possible to realize a more reliable water-stopping treatment.

Moreover, the terminal to be fixed at the terminal fixing step need not always be the earthing connection terminal but may be the terminal to be fixed on the terminal (e.g., the terminal to be connected with the side of the load mounted on the vehicle) on the opposite side. In this case, too, a satisfactory water-stopping structure can be constructed at the position on this side of that terminal. In this case, however, the water may invade into the insulating material 14 in the region from the earth connection portion to the water-stopping structure of the terminal on the opposite side. An advantage that the invasion of the water into the inner side-side 46 of the insulating material 14 can be substantially reliably blocked, if the water-stopping agent is fed to the terminal on the side (i.e., the entrance side of the water to invade from the earth connection portion), on which the earthing connection terminal 20 is fixed, as described before.

Example

The water-stopping treatment was performed by the method, as shown in FIGS. 1A and 1B to FIG. 3, under the following conditions:

Length of Electric Wire: 0.5 to 1.5 m;
Sectional Area of Electric Wire: 2 $mm^2$;
Water-Stopping Agent Used: Silicone Rubber (Viscosity: 0.6 Pa·s);
Dripping Quantity of Water-Stopping Agent: (about 1 to 2 droplets);
Pressure at Reduced Time: 80 Kpa; and
Pressure Reducing Time: 10 to 20 seconds from Feeding Instant of Water-Stopping Agent.

As a result of this treatment, it could be confirmed that the water-stopping agent had penetrated into the inner side of the insulating material 14 over the region of 10 to 50 mm from the electric wire terminal. Moreover, this electric wire was subjected to a cold temperature endurance test over 1,000 cycles within a temperature range of −40° C. to 120° C. and a high temperature protracted test at a temperature of 160° C. or lower over 120 hours. It could also be confirmed even after the tests that the water-stopping agent had exhibited a sufficient water-stopping effect on the pressure up to 200 Kpa.

In the case of no pressure reducing step, on the contrary, it has been confirmed that the water-stopping agent penetrated into the region of about 3 to 10 mm at the deepest from the electric wire terminal.

According to the invention, as has been described hereinbefore, the flowable water-stopping agent is caused to penetrate into the inner side of the coating material by feeding the water-stopping agent to one terminal of the earthing electric wire and by sucking the air during or after the feed on the inner side of the coating material of the earthing electric wire from the other terminal of the earthing electric wire thereby to reduce the pressure. Therefore, the invention has an effect capable of performing the water-stopping treatment of the earthing electric wire reliably by the simple operation without increasing the volume of the electric wire terminal portion so much.

What is claimed is:

1. An electric wire having a first end comprising:

a conductor;

a clamping terminal clamped to a length of the conductor at the first end of the wire;

a coating material outside of the conductor and extending along substantially an entire length of the conductor except the length of the conductor at the first end of the wire, which is free of the coating material; wherein a water-stopping agent having a flowability contacts the conductor, after clamping the clamping terminal to the conductor and is located between a position where the clamping terminal clamps to the conductor and an edge of the coating material; and a conductor barrel being disposed around an entire circumference of the first end of the wire;

wherein the conductor at the first end of the wire is exposed between the conductor barrel and the coating material.

2. An electric wire having a first end according to claim 1, wherein the water-stopping agent penetrates between the conductor and an inner side of the coating material.

3. An electric wire having a first end according to claim 1, wherein the clamping terminal comprises an insulator barrel clamped to the coating material at the first end of the electric wire; and a conductor barrel clamped to the conductor at the first end of the electric wire.

4. An electric wire having a first end according to claim 3, wherein the conductor barrel surrounds the conductor at a position between the insulation barrel and an end of the conductor.

5. An electric wire having a first end according to claim 3, wherein the water-stopping agent contacts the conductor at a position between the conductor barrel and the insulation barrel so the water-stopping agent can penetrate an inner side of the coating material.

6. An electric wire with a terminal comprising:

a conductor:

a clamping terminal clamped to a terminal clamping portion of the conductor; and a coating material outside of the conductor and extending along substantially an entire length of the conductor except for an end portion of the conductor that is free of the coating material, wherein a water-stopping agent having a flowability contacts the conductor after clamping the clamping terminal to the terminal clamping portion of the conductor and is located between the conductor and the coating material at least at an inner side of the coating material on the terminal clamping portion of the conductor, wherein the coating material contains the water-stopping agent on its inner side wherein at an end of the wire, opposite to the clamping portion of the conductor, does not have the water-stopping applied between the conductor and the coating material.

7. An electric wire with a terminal according to claim 6, wherein the water-stopping agent has hardened on the inner side of the coating material.

* * * * *